US005692255A

United States Patent [19]

Canfield

[11] Patent Number: 5,692,255

[45] Date of Patent: Dec. 2, 1997

[54] APPARATUS FOR ELEVATING THE FOOT OF A BED

[76] Inventor: Grant Canfield, 1088 Phelan Rd., Phelan, Calif. 92329

[21] Appl. No.: 782,619

[22] Filed: Jan. 13, 1997

[51] Int. Cl.[6] ..... A47C 21/02; A47C 31/00

[52] U.S. Cl. ..... 5/505.1; 5/660

[58] Field of Search ..... 5/658, 660, 503.1, 5/504.1, 506.1, 509.1

[56] References Cited

U.S. PATENT DOCUMENTS

| | | | |
|---|---|---|---|
| 649,901 | 5/1900 | Brennan | 5/503.1 |
| 884,393 | 4/1908 | Keasey | 5/503.1 |
| 1,371,196 | 3/1921 | Cook | 5/660 |
| 2,381,509 | 8/1945 | Muenzen | 5/660 |
| 3,826,490 | 7/1974 | Mossman | 5/658 |
| 4,493,121 | 1/1985 | Williams | 5/505.1 |
| 4,624,022 | 11/1986 | Dolan | 5/658 |

*Primary Examiner*—Flemming Saether

[57] ABSTRACT

An apparatus for elevating the foot of a bed comprises an elevating system comprising a hinged support board and a lifting device, the hinged support board being formed in a generally rectangular configuration, the support board having hingedly coupled upper and lower regions, the support board being positioned beneath the mattress of a bed; the lifting device comprising a base, a vertical support and board and blanket pulleys, the vertical support being coupled to the base, the pulleys being coupled to the vertical support; board and blanket pulleys each including a pulley spool, a cord and a handle, the cord of the board pulley having an upper end wound around the pulley spool and a lower end coupled to the lower region of the board, the cord of the blanket pulley having an upper end wound around the pulley spool and a lower end including blanket coupling devices, in an operative orientation a user turning each of the handles thereby raising a blanket and the board to a desired elevation, securing devices enabling the user to retain the blanket and the board at a desired location.

4 Claims, 3 Drawing Sheets

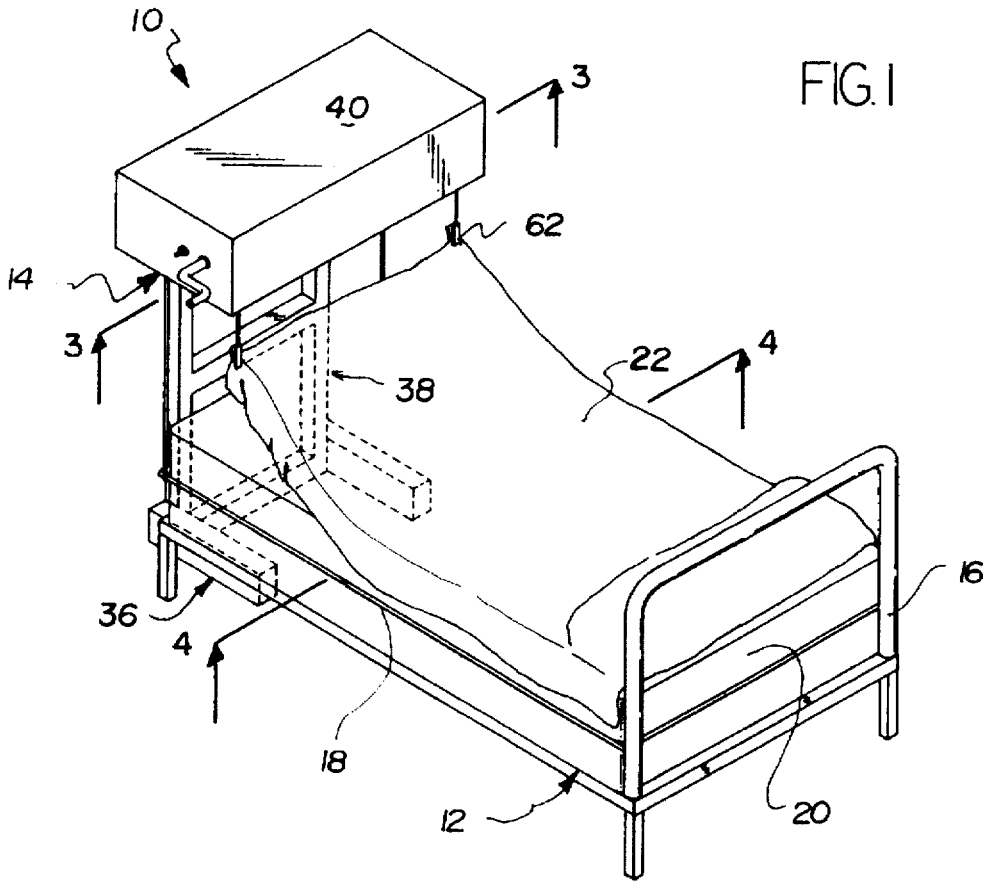
FIG. 1
FIG. 2
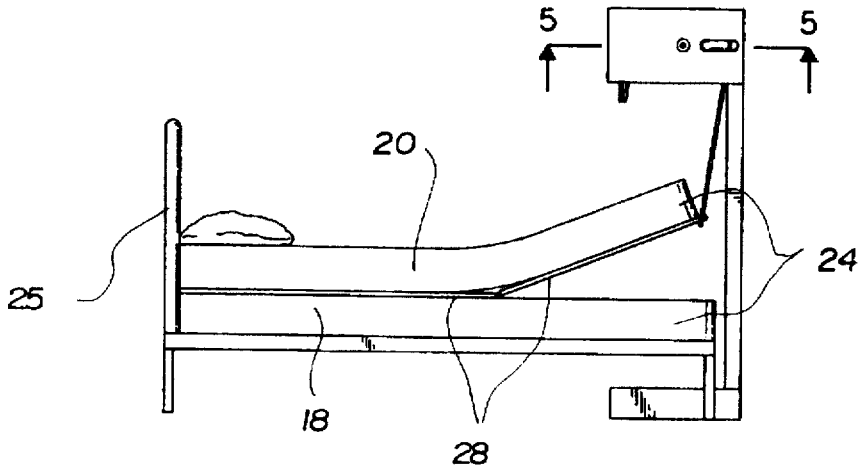

APPARATUS FOR ELEVATING THE FOOT OF A BED

BACKGROUND OF THE INVENTION

1. Field of the Invention

The present invention relates to an apparatus for elevating the foot of a bed and more particularly pertains to conveniently manually raising the foot of a bed to alleviate medical conditions.

2. Description of the Prior Art

The use of adjustable beds is known in the prior art. More specifically, adjustable beds heretofore devised and utilized for the purpose of providing adjustment means to a bed are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,199,122 to Styblo discloses bed angle elevators.

U.S. Pat. No. 5,160,010 to Peterson discloses an adjustable bed with side rail.

U.S. Pat. No. 4,847,930 to Spath discloses a raising device for attachment to hospital beds.

U.S. Pat. No. 5,084,921 to Hicks, Jr. discloses a supine patient lift and transfer apparatus.

U.S. Pat. No. 4,285,079 to Hillman discloses an apparatus for raising and lowering the mattress of a crib.

U.S. Pat. No. 4,398,313 to Mitchell discloses a manual control system for adjustable hospital bed.

While these devices fulfill their respective, particular objective and requirements, the aforementioned patents do not describe an apparatus for elevating the foot of a bed for conveniently manually raising the foot of a bed to alleviate medical conditions.

In this respect, the apparatus for elevating the foot of a bed according to the present invention substantially departs from the conventional concepts and designs of the prior art, and in doing so provides an apparatus primarily developed for the purpose of conveniently manually raising the foot of a bed to alleviate medical conditions.

Therefore, it can be appreciated that there exists a continuing need for new and improved apparatus for elevating the foot of a bed which can be used for conveniently manually raising the foot of a bed to alleviate medical conditions. In this regard, the present invention substantially fulfills this need.

SUMMARY OF THE INVENTION

In the view of the foregoing disadvantages inherent in the known types of adjustable beds now present in the prior art, the present invention provides an improved apparatus for elevating the foot of a bed. As such, the general purpose of the present invention, which will be described subsequently in greater detail, is to provide a new and improved apparatus for elevating the foot of a bed and method which has all the advantages of the prior art and none of the disadvantages.

To attain this, the present invention essentially comprises a new and improved apparatus for elevating the foot of a bed comprising, in combination: a bed formed in a generally rectangular configuration and including a frame, a box spring, a mattress and a blanket, the bed having a foot section and a head section including a headboard; an elevating system comprising a hinged support board and lifting means, the hinged support board being formed in a generally rectangular configuration and having approximately the same length and width as the bed, the support board having an upper region and a lower region, the upper and lower regions being coupled together by three hinges, the upper region having a greater length than the lower region, the support board being positioned on the bed between the box spring and the mattress with the upper region below the head section of the bed and the lower region below the foot section of the bed; the lifting means comprising a base, a vertical support and a pulley cabinet, the base being formed as two generally rectangular bars extending horizontally beneath the foot section of the bed, the vertical support being formed in a generally U-shaped configuration with a lower cross bar, a middle cross bar and two side bars each having upper extents, the lower cross bar being coupled to the base, the pulley cabinet being affixed to the upper extent of each of the side bars; the pulley cabinet being formed in a generally rectangular configuration with a top, a bottom, two long side walls, a first short side wall and a second short side wall, each of the short side walls including a pin aperture and a shaft aperture extending therethrough, the bottom including four generally rectangular cord apertures extending therethrough, board and blanket pulleys being positioned within the pulley cabinet, each pulley including a pulley spool, a cord, a shaft, a pin and an L-shaped handle, each shaft being formed in an elongated generally cylindrical configuration and formed contiguously with the L-shaped handle, each pulley spool being formed of opposing spaced discs coupled around one of the shafts, each disc including a plurality of peripheral holes extending therethrough, the cord of the board pulley having an upper end wound around the pulley spool and a lower end coupled to the lower region of the board by a plurality of brackets, the cord of the blanket pulley having an upper end wound around the pulley spool and a lower end including a clip coupled to the blanket, the cord extending through the cord apertures in the pulley cabinet, in an operative orientation a user turning each of the handles thereby raising the blanket and the board to a desired elevation, the user then securing the blanket and the board at the desired location by positioning the pins through the pin apertures in the pulley cabinet and a peripheral hole in a disc of a pulley spool.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved apparatus for elevating the foot of a bed which has all the advantages of the prior art adjustable beds and none of the disadvantages.

It is another object of the present invention to provide a new and improved apparatus for elevating the foot of a bed which may be easily and efficiently manufactured and marketed.

It is a further object of the present invention to provide a new and improved apparatus for elevating the foot of a bed which is of durable and reliable construction.

An even further object of the present invention is to provide a new and improved apparatus for elevating the foot of a bed which is susceptible of a low cost of manufacture with regard to both materials and labor, and which accordingly is then susceptible of low prices of sale to the consuming public, thereby making such an apparatus for elevating the foot of a bed economically available to the buying public.

Even still another object of the present invention is to provide a new and improved apparatus for elevating the foot of a bed for conveniently manually raising the foot of a bed to alleviate medical conditions.

Lastly, it is an object of the present invention to provide a new and improved apparatus for elevating the foot of a bed comprising: an elevating system comprising a hinged support board and lifting means, the hinged support board being formed in a generally rectangular configuration, the support board having hingedly coupled upper and lower regions, the support board being positioned beneath the mattress of a bed; the lifting means comprising a base, a vertical support and board and blanket pulleys, the vertical support being coupled to the base, the pulleys being coupled to the vertical support; board and blanket pulleys each including a pulley spool, a cord and a handle, the cord of the board pulley having an upper end wound around the pulley spool and a lower end coupled to the lower region of the board, the cord of the blanket pulley having an upper end wound around the pulley spool and a lower end including blanket coupling means, in an operative orientation a user turning each of the handles thereby raising a blanket and the board to a desired elevation, securing means enabling the user to retain the blanket and the board at a desired location.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the apparatus for elevating the foot of a bed constructed in accordance with the principles of the present invention.

FIG. 2 discloses a side perspective view of the apparatus illustrating the mattress in a raised orientation.

The same reference numerals refer to the same parts through the various Figures.

DESCRIPTION OF THE PREFERRED EMBODIMENT

Figure 3:
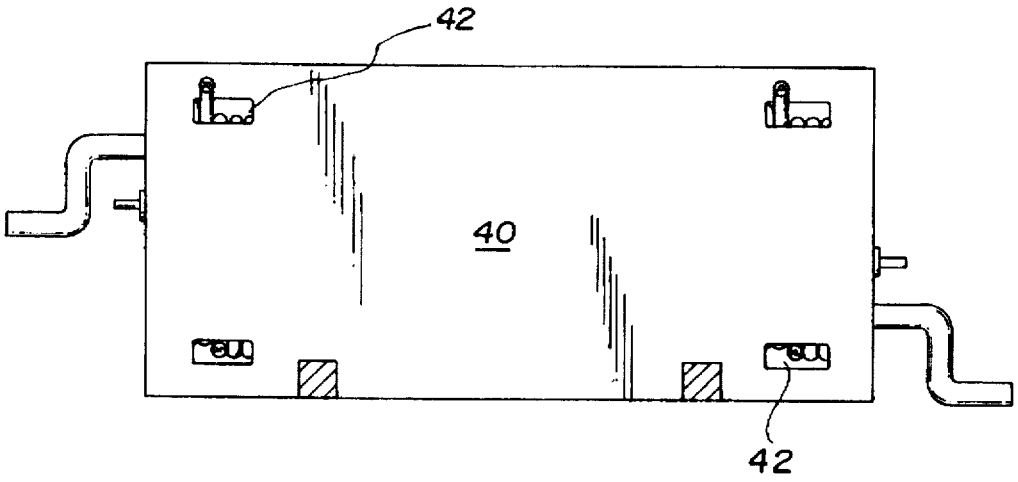
FIG. 3 is a bottom perspective view of the pulley cabinet taken along section line 3—3 of FIG. 1.

With reference now to the drawings, and in particular, to FIG. 1 thereof, the preferred embodiment of the new and improved apparatus for elevating the foot of a bed embodying the principles and concepts of the present invention and generally designated by the reference number 10 will be described.

Specifically, it will be noted in the various Figures that the device relates to an apparatus for elevating the foot of a bed 10. In its broadest context, the device consists of a bed 12 and an elevating system 14. Such components are individually configured and correlated with respect to each other so as to attain the desired objective.

The bed 10 is formed in a generally rectangular configuration and including a frame 16, a box spring 18, a mattress 20 and a blanket 22. The bed has a foot section 24 and a head section including a headboard 25. In alternative embodiments of the apparatus a bed is not included. Rather, the present invention is utilized in association with an existing bed. Note FIG. 1.

Figure 4:
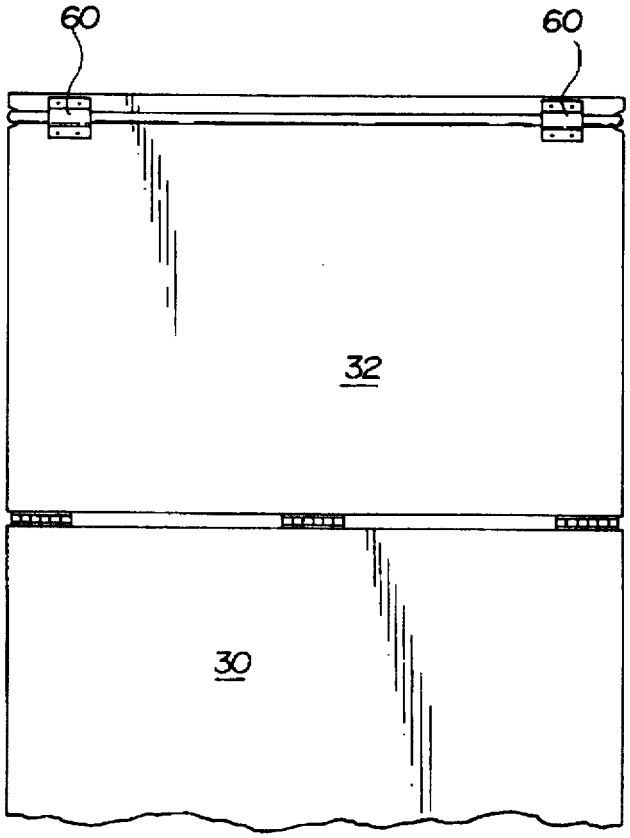
FIG. 4 is a perspective view of the hinged support board taken along section line 4—4 of FIG. 1.

The elevating system 14 comprises a hinged support board 28 and lifting means. The hinged support board 28 is formed in a generally rectangular configuration and has approximately the same length and width as the bed. The support board may be fabricated in a variety of sizes to accommodate different sized beds. In the preferred embodiment the support board is fabricated of wood, but in alternate embodiments it is fabricated of metal or plastic. The support board has an upper region 30 and a lower region 32. The upper and lower regions are coupled together by three hinges 34. The upper region has a greater length than the lower region. The support board 28 is positioned on the bed between the box spring 18 and the mattress 20 with the upper region 30 below the head section of the bed and the lower region 32 below the foot section of the bed. Note FIGS. 2 and 4.

The lifting means comprises a base 36, a vertical support 38 and a pulley cabinet 40. In the preferred embodiment the lifting means is fabricated of wood, but in alternate embodiments it is fabricated of metal or plastic. The base 36 is formed as two generally rectangular bars extending horizontally beneath the foot section of the bed. The vertical support 38 is formed in a generally U-shaped configuration with a lower cross bar, a middle cross bar and two side bars each having upper extents. The lower cross bar is coupled to the base. The pulley cabinet 40 is affixed to the upper extent of each of the side bars. This configuration provides a stable support for the pulley cabinet and minimizes space requirements since the base can be slid underneath the bed. Note FIGS. 1 and 2.

The pulley cabinet 40 is formed in a generally rectangular configuration with a flat top, a bottom, two long side walls, a first short side wall and a second short side wall. Each of the short side walls includes a pin aperture and a shaft aperture. The bottom includes four generally rectangular cord apertures 42. In the preferred embodiment the pulley cabinet is fabricated of wood, but in alternate embodiments it is fabricated of metal or plastic. The flat top permits a user to rest a television, radio, computer or other articles upon the pulley cabinet. Note FIGS. 1 and 3.

Figure 5:
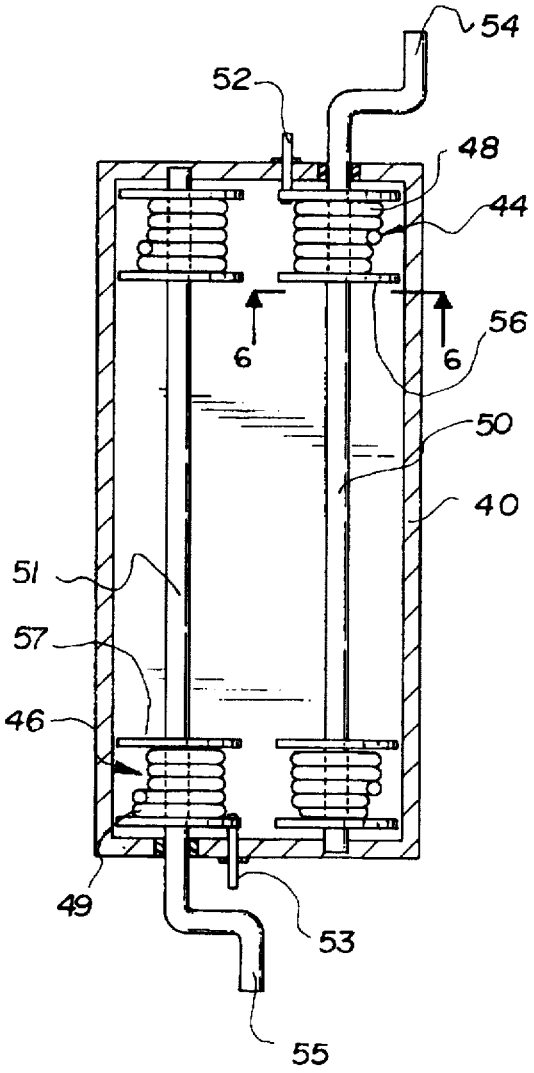
FIG. 5 is a cross-sectional view of the pulley cabinet taken along section line 5—5 of FIG. 2.

Board 44 and blanket 46 pulleys are positioned within the pulley cabinet 40. Each pulley includes a pulley spool, a cord 48, 49, a shaft 50, 51 a pin 52, 53 and an L-shaped handle 54, 55. Each shaft is formed in an elongated generally cylindrical configuration and formed contiguously with the L-shaped handle. The L-shaped configuration of the handle allows for easy turning by a user. Note FIG. 5.

Figure 6:
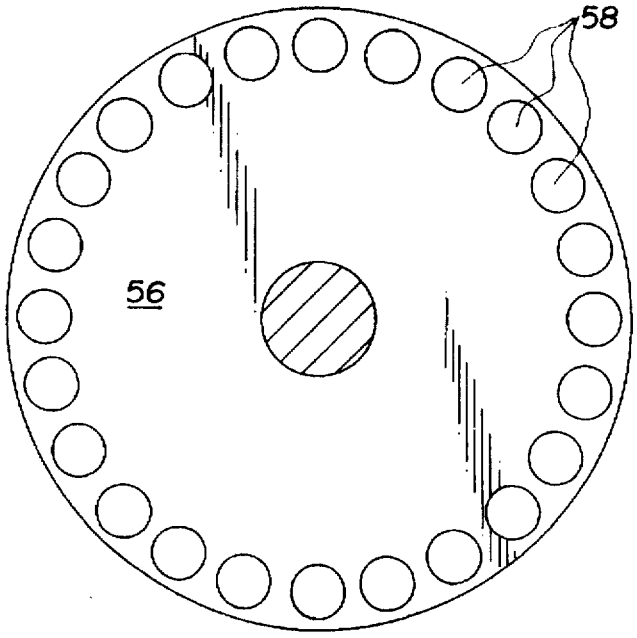
FIG. 6 is a bottom perspective view of the board pulley spool taken along section line 6—6 of FIG. 5.

Each pulley spool is formed of opposing spaced discs 56, 57 coupled around one of the shafts. Each disc 56, 57 includes a plurality of peripheral holes 58. The cord of the board pulley 48 has an upper end wound around the pulley spool and a lower end coupled to the lower region of the board by a plurality of brackets 60. The cord of the blanket pulley 49 has an upper end wound around the pulley spool and a lower end which includes a clip 62 coupled to the blanket 22. The cord 48, 49 extends through the cord apertures 42 in the pulley cabinet. In the preferred embodiment of the apparatus, the cord is fabricated of NYLON. Note FIGS. 5 and 6.

In an operative orientation a user turns each of the handles 54, 55 thereby raising the blanket 22 and the board 28 to a desired elevation. The user then secures the blanket and the board at the desired location by positioning the pins 52, 53 through the pin apertures in the pulley cabinet 40 and a peripheral hole 58 in a disc 56, 57 of a pulley spool. The separate pulley devices permit users to raise the blanket and the board independently. The configuration of the board pulley significantly reduces the force required by users to elevate the board, mattress, and legs of an individual in the bed. The present invention is very useful for individuals who require therapeutic leg elevation for ailments or conditions such as orthopedic problems, diabetes, congestive heart failure, pregnancy, water retention, and swollen ankles. Note FIGS. 1 and 2.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A new and improved apparatus for elevating the foot of a bed comprising, in combination:

a bed formed in a generally rectangular configuration and including a frame, a box spring, a mattress and a blanket, the bed having a foot section and a head section including a headboard;

an elevating system comprising a hinged support board and lifting means, the hinged support board being formed in a generally rectangular configuration and having approximately the same length and width as the bed, the support board having an upper region and a lower region, the upper and lower regions being coupled together by three hinges, the upper region having a greater length than the lower region, the support board being positioned on the bed between the box spring and the mattress with the upper region below the head section of the bed and the lower region below the foot section of the bed;

the lifting means comprising a base, a vertical support and a pulley cabinet, the base being formed as two generally rectangular bars extending horizontally beneath the foot section of the bed, the vertical support being formed in a generally U-shaped configuration with a lower cross bar, a middle cross bar and two side bars each having upper extents, the lower cross bar being coupled to the base, the pulley cabinet being affixed to the upper extent of each of the side bars;

the pulley cabinet being formed in a generally rectangular configuration with a top, a bottom, two long side walls, a first short side wall and a second short side wall, each of the short side walls including a pin aperture and a shaft aperture extending therethrough, the bottom including four generally rectangular cord apertures extending therethrough, board and blanket pulleys being positioned within the pulley cabinet, each pulley including a pulley spool, a cord, a shaft, a pin and an L-shaped handle, each shaft being formed in an elongated generally cylindrical configuration and formed contiguously with the L-shaped handle, each pulley spool being formed of opposing spaced discs coupled around one of the shafts, each disc including a plurality of peripheral holes extending therethrough, the cord of the board pulley having an upper end wound around the pulley spool and a lower end coupled to the lower region of the board by a plurality of brackets, the cord of the blanket pulley having an upper end wound around the blanket pulley spool and a lower end including a clip coupled to the blanket, the cord of the blanket pulley extending through the cord apertures in the pulley cabinet, in an operative orientation a user turning each of the handles thereby raising the blanket and the board to a desired elevation, the user then securing the blanket and the board at the desired location by positioning the pins through the pin apertures in the pulley cabinet and a peripheral hole in a disc of a pulley spool.

2. An apparatus for elevating the foot of a bed comprising:

an elevating system comprising a hinged support board and lifting means, the hinged support board being formed in a generally rectangular configuration, the support board having hingedly coupled upper and lower regions, the support board being positioned beneath a mattress of a bed;

the lifting means comprising a base, a vertical support and board and blanket pulleys, the vertical support being coupled to the base, the pulleys being coupled to the vertical support;

board and blanket pulleys each including a pulley spool, a cord and a handle, the cord of the board pulley having an upper end wound around the pulley spool and a lower end coupled to the lower region of the board, the cord of the blanket pulley having an upper end wound around the pulley spool and a lower end including blanket coupling means, in an operative orientation a user turning each of the handles thereby raising a blanket and the board to a desired elevation, securing means enabling the user to retain the blanket and the board at a desired location; and a pulley cabinet including a top, a bottom and side walls, each of the short side walls including circular apertures extending therethrough, the bottom including four cord apertures extending therethrough, the board and blanket pulleys being positioned within the pulley cabinet.

3. The apparatus for elevating the foot of a bed as set forth in claim 2 wherein the each of the pulley spools are formed as discs with a plurality of holes therethough and wherein the securing means comprises a pin being positionable through the circular aperture in the pulley cabinet and the holes in the discs to secure the pulley spools at a desired elevation.

4. The apparatus for elevating the foot of a bed as set forth in claim 2 wherein the base is formed as two horizontal bars extending beneath the foot section of the bed, the vertical support including a lower cross bar, a middle cross bar and two side bars each having upper extents, the pulley cabinet being affixed to the upper extent of each of the side bars.

* * * * *